US005167597A

United States Patent [19]

David

[11] Patent Number: 5,167,597

[45] Date of Patent: Dec. 1, 1992

[54] WHEELED WALKER TREATMENT METHOD

[76] Inventor: George David, 2334 California St., San Francisco, Calif. 94115

[21] Appl. No.: 770,092

[22] Filed: Oct. 1, 1991

[51] Int. Cl.[5] ..... A61H 3/00

[52] U.S. Cl. ..... 482/68; 280/87.021; 280/267; 297/5

[58] Field of Search ..... 482/66, 67, 68, 69; 280/87.021, 87.041, 87.042, 200, 263, 267, 270; 297/4, 5, 6

[56] References Cited

U.S. PATENT DOCUMENTS

| | | | |
|---|---|---|---|
| 1,387,091 | 8/1921 | Woolley et al. | 280/263 X |
| 3,180,678 | 4/1965 | McCabe | 482/68 X |
| 3,183,028 | 5/1965 | Williams | 482/68 X |
| 3,529,819 | 9/1970 | Blank | 482/68 |
| 3,992,024 | 11/1976 | Workman | 280/87.041 |
| 4,065,145 | 12/1977 | Chambers | 297/5 X |
| 4,225,146 | 9/1980 | Takeuchi | 482/68 X |
| 4,226,413 | 10/1980 | Daugherty | 482/68 X |
| 4,277,100 | 7/1981 | Beougher | 482/68 X |
| 4,281,844 | 8/1981 | Jackman et al. | 280/263 X |
| 4,307,715 | 12/1981 | Fante | 482/68 X |
| 4,342,465 | 8/1982 | Stillings | 482/68 X |
| 4,398,734 | 8/1983 | Barnard | 280/87.042 X |
| 4,463,817 | 8/1984 | Mennesson | 482/68 X |
| 4,681,332 | 7/1987 | Malone | 482/68 X |
| 4,732,400 | 3/1988 | Santini | 280/87.042 |
| 4,796,903 | 1/1989 | Proctor et al. | 482/68 X |
| 4,807,870 | 2/1989 | Hickman | 482/68 |
| 4,861,051 | 8/1989 | Napper | 482/68 X |
| 4,890,853 | 1/1990 | Olson | 482/66 X |
| 4,941,497 | 7/1990 | Prather et al. | 482/68 X |
| 4,985,947 | 1/1991 | Ethridge | 482/68 X |

FOREIGN PATENT DOCUMENTS

| | | | |
|---|---|---|---|
| 2467003 | 5/1981 | France | 280/87.042 |

*Primary Examiner*—Robert Bahr

*Attorney, Agent, or Firm*—Douglas E. White

[57] ABSTRACT

A method for treating ambulatory disease in a human patient having a torso, buttocks, legs, feet and hands, which legs and feet execute a normal stride pattern. A walker has a chassis having interconnected tubes all contained within a single plane, which chassis fits within the normal stride pattern without substantial obstruction thereof. A telescopically adjustable straddle seat is affixed to the chassis which allows the patient's legs to be disposed moveably forward and backward on opposite sides of the seat. A rotatable handlebar rotated at least one wheel of the walker. Wheels are affixed on the underside of the chassis. The patient is seated on the walker so as to support a portion of the patient's weight, but not the entirety thereof, when the patient is standing in a normal upright positure with the buttocks resting on the seat. The patient walks in the normal stride pattern while steering the walker with the hands on the handlebar.

12 Claims, 3 Drawing Sheets 2
3
9
20
9
22
24
4
70
10
74
76
78
1
6
14
12
18
32
28
30
5
16
52
32
60
8
7
50
52

WHEELED WALKER TREATMENT METHOD

FIELD OF THE INVENTION

This invention relates to the treatment of human ambulatory diseases or disorders, more particularly to a method of treatment utilizing a wheeled walker which properly exercises a patient's muscles while providing a means of locomotion.

BACKGROUND OF THE INVENTION

Persons with diseases such as diabetic neuropathy, arteriosclerosis, spinal stenosis, and the like often experience difficulty or inability in ambulation (walking). At the same time, if such patients do not force themselves to walk—despite such difficulty or pain—their condition may worsen over time, to the point where the inability to walk becomes irreversible.

Canes, crutches and multi-legged walkers are often prescribed, but many patients find these difficult and cumbersome to use. Often, the only comfortable alternative is a wheelchair, which itself can be the cause of progressive ambulatory deterioration.

Prior developments in this field may be generally illustrated by reference to the following patents:

| Patent No. | Patentee | Issue Date |
|---|---|---|
| 4,941,670 | D. Parr | Jul. 17, 1990 |
| 2,530,544 | O. Schwantes | Nov. 21, 1950 |
| 4,681,332 | D. Malone | Jul. 21, 1987 |
| 1,658,068 | A. White | Feb. 05, 1924 |
| 4,755,162 | J. Chao | Oct. 04, 1988 |
| 4,552,372 | D. Jones | Nov. 12, 1985 |
| 3,333,862 | J. Rockwell | Aug. 01, 1967 |

U.S. Pat. No. 4,941,670 teaches a mobile push-type toy vehicle having skateboard wheels. It cannot be steered, other than by leaning.

U.S. Pat. No. 4,681,332 teaches a collapsible four-wheeled vehicle which also has no rotatable steering means. The vehicle may be used to train skaters.

U.S. Pat. No. 2,530,544 teaches a walking chair with four wheels. It is steered by swivel casters, which can be a cumbersome and tiring steering method. The construction of the seat is such that the operator would have to be either freely standing or fully seated in order to use the device, such that in the latter case his or her feet would not be able to complete a normal stride. That is to say, in this prior art device, the patient's knees must always remain in front of the edge of the chair seat when the patient is seated. It is therefore unsuited for therapy which attempts to replicate a patient's normal stride.

The rest of the patents are representative of what is in the art.

SUMMARY OF THE INVENTION

The present invention is a therapeutic treatment method utilizing a wheeled walker which supports a large portion of the user's weight on a raised seat, in the manner of a bicycle. The walker is propelled by one's feet, using a more or less normal stride. Like a bicycle, it can be steered with a handlebar. However, in order to remain stable at a very slow rate of forward movement, as well as to remain stable while at rest, the device is supported on four small wheels of the roller-skate or skateboard type, rather than on two large wheels of the bicycle type. The therapy taught herein allows patients to use their feet and legs in a natural manner to motivate themselves, thereby exercising the proper muscle groups. At the same time, enough weight is taken off of the hips, legs and feet to compensate for existing injury and to allow damaged tissue to heal.

FEATURES AND ADVANTAGES

An object of this invention is to disclose a method of treating ambulatory disease in a human patient having a torso, buttocks, legs, feet and hands, which legs and feet execute a normal stride pattern. The therapy method includes providing a walker having a chassis which fits within the normal stride pattern without substantial obstruction thereof, having a straddle seat affixed to the chassis which allows the patient's legs to be disposed moveably forward and backward on opposite sides thereof, and having wheels on the underside of the chassis. Another step of the treatment method is to seat the patient on the walker so as to support a portion of the patient's weight, but not the entirety thereof, when the patient is standing in a normal upright posture with the buttocks resting on the seat.

Another object is to disclose a walker which has means for telescopically raising or lowering the straddle seat means.

Yet another object is to further include in the method the step of having the patient walk in the normal stride pattern while steering the walker with the hands on the handlebar.

Yet another feature of the walker is four wheels, two wheels on a front truck, the front truck operably connected to the handlebar so as to be rotatable therewith and two wheels on a rear truck, the rear truck affixed to the chassis so as to be stable with respect thereto.

Still another feature is that each truck includes elastic bushings for allowing the walker to flexibly lean to one side or the other.

Another feature is a therapy which is easy to learn and perform and which utilizes an apparatus that is attractive in appearance and suitable for mass production at relatively low cost.

Other novel features which are characteristic of the invention, as to organization and method of operation, together with further objects and advantages thereof will be better understood from the following description considered in connection with the accompanying drawing in which a preferred embodiment of the invention is illustrated by way of example. It is to be expressly understood, however, that the drawing is for the purpose of illustration and description only and is not intended as a definition of the limits of the invention.

Certain terminology and derivations thereof may be used in the following description for convenience in reference only and will not be limiting. For example, the words "upwardly," "downwardly," "leftwardly," and "rightwardly" will refer to directions in the drawings to which reference is made unless otherwise stated. Similarly, the words "inwardly" and "outwardly" will refer to directions toward and away from, respectively, the geometric center of a device and designated parts thereof.

Figure 1:
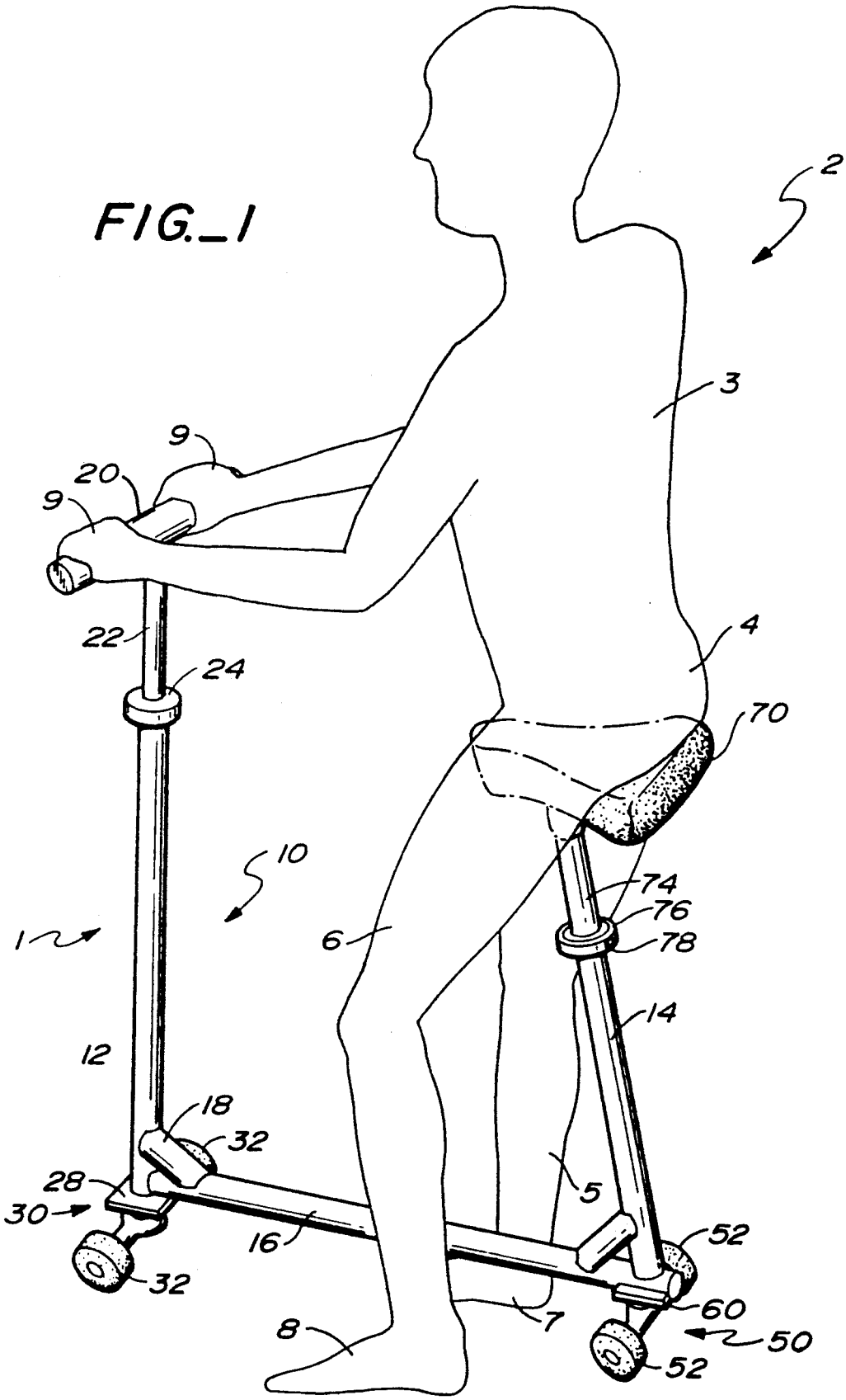
FIG. 1 is a perspective view of a wheeled walker, showing it in use by a patient practicing the method of this invention.

Drawing Reference Numerals 1. walker
2. patient
3. torso of 2
4. buttocks of 2
5. right leg of 2
6. left leg of 2
7. right foot of 2
8. left foot of 2
9. hands of 2
10. chassis
12. steering column of 10
14. seat column of 10
16. straddle tube of 10
18. brackets for 12, 14
20. handlebar
22. steering post in 12
24. bearing between 12, 22
26. thrust bearing between 12, 28
28. front plate on 22
30. front wheel truck
32. wheels of 30
34. axle for 32
36. body of 30
38. elastic bushings on 40
40. stub axle of 36
42. nut on 40
44. platform of 36
46. bolts for 28, 44
50. rear wheel truck
52. wheels of 50
54. body of 50
56. platform of 50
58. bolts for 56, 60
60. rear plate on 16
70. straddle seat
72. pivot bracket of 70, 74
74. seat post of 70
76. adjustment collar for 74
78. set screw of 76

DESCRIPTION OF A PREFERRED EMBODIMENT

Figure 2:
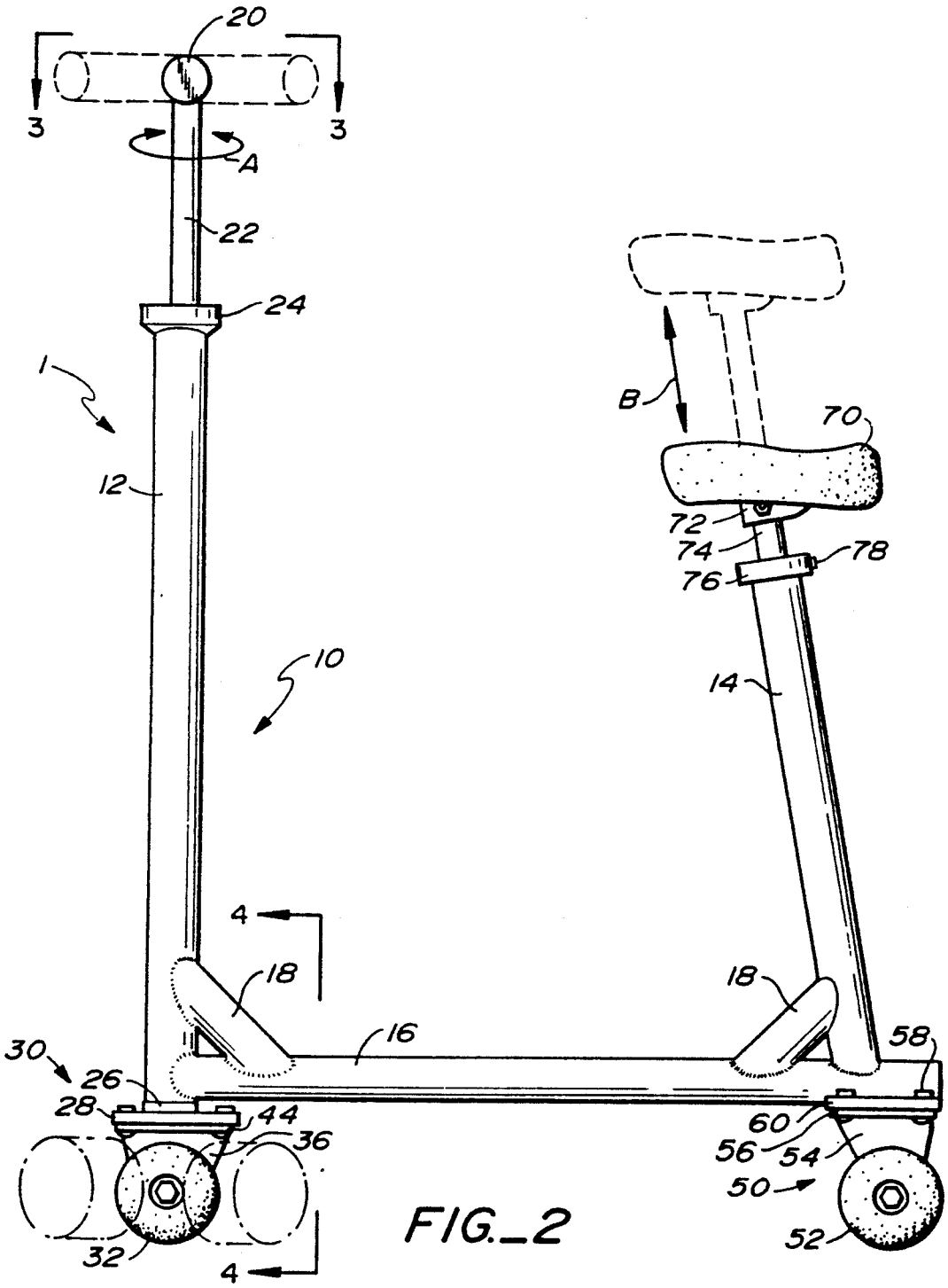
FIG. 2 is a front elevation of the wheeled walker of FIG. 1.

Referring to FIGS. 1 and 2, there is illustrated therein a preferred wheeled walker 1 of this invention. A patient 2 is shown straddling the walker in accordance with the preferred treatment method of this invention.

The walker 1 has a chassis 10, preferably formed of strong tubular construction. The chassis could also be formed of channel bar or other suitable configurations of metal, chosen to resist deformation. While aluminum is preferred for its light weight, steel or other metals could also be utilized. Some configurations could include wood or plastic components.

The chassis 10 is comprised of a generally vertical steering column 12, a generally vertical seat column 14 (which may incline forwardly, as drawn) and, rigidly connecting the two vertical columns, a single horizontal straddle bar or tube 16. These three tubes are welded together, with their points of interconnection preferably strengthened by angle brackets 18. It can be seen that the tubes 12, 14, 16 of the chassis 10 are all in the same vertical plane. This allows the walker 1 to be used by a patient 2 without presenting obstacles within the patient's normal stride pattern.

A handlebar 20 is connected to a steering post 22. The steering post is journaled into the steering column 12 so as to be freely rotatable there within. A first bearing 24 supports the entry of the steering post 22 into the top of the steering column 12. A thrust bearing 26 supports the exit of the lower end of the steering post from the bottom of the steering column. A front plate 28, or other suitable mounting means, is attached to the lower end of the steering post 22 and pushes up against the thrust bearing 26 when the walker 1 is used in the treatment of this invention (described below).

Figure 4:
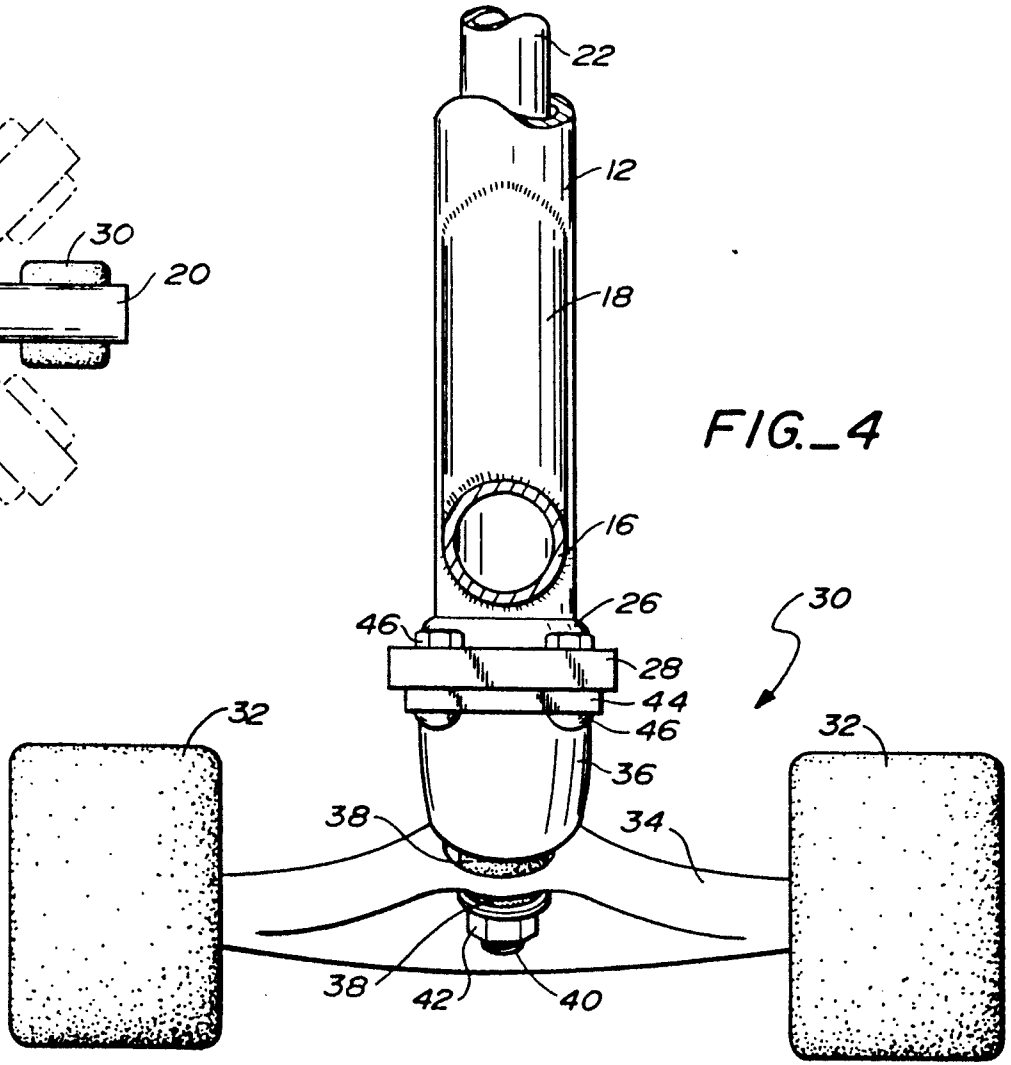
FIG. 4 is a broken side sectional elevation of the walker, taken along line 4—4 of FIG. 2.

Referring also to the detail view in FIG. 4, a front wheel bogie or truck, generally designated 30, is rigidly attached to the front plate 28. This truck is of a prior-art type generally found on modern skateboards or skates. A pair of wheels 32 are mounted on opposite ends of a non-rotating axle 34. The axle 34 depends downwardly from a support or body 36 of the truck 30 by means of a stub axle 40. The axle 34 is mounted on the stub axle 40 between a pair of relatively thick elastic bushings 38 and is held onto the body 36 by means of a nut 42 on the stub axle 40.

Figure 3:
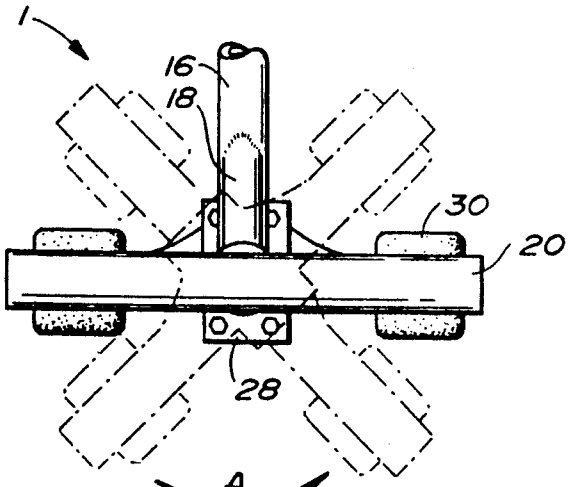
FIG. 3 is a broken plan view of the front portion of the walker, taken along line 3—3 of FIG. 2.

The body 36 of the front wheel truck 30 is welded or otherwise attached to a flat platform 44, which platform is, in turn, affixed to the front plate 28 of the steering post 22 by means of a plurality of bolts 46. This allows the truck 32 to be rotated from side-to-side in tandem with the handlebar 20 to steer the walker 1 (see arrow A in the detail view of FIG. 3).

The flexibility of the bushings 38 allows the axle 34 to bend from side-to-side relative to the stub axle 40 when the patient 2 shifts his or her body weight. In the prior art, this feature is designed to allow, for example, the user of a skateboard to steer. However, in this application (given the handlebar steering means discussed above) it may primarily be used to provide an extra degree of comfort to the patient 2. For example, the bushings 38 allow the walker 1 to be tilted to one side, then the other, when the patient is walking or at rest so that the patient can support his or her weight alternately on one leg or the other in a natural manner. In addition to providing comfort, this feature facilitates therapy, which therapy is directed toward replicating the patient's natural movements as much as possible, while relieving strains that are due to the patient's body weight.

A rear wheel truck 50 has a pair of wheels 52, similarly attached to a body 54 by means of a stub axle and elastic bushings (not illustrated). The body of the rear truck is integrated with an upper platform 56 which is affixed to a rear plate 60 of the chassis 10 by means of a set of bolts 58. The rear plate 60, unlike the front plate 28, is not rotatable. It is welded or otherwise permanently affixed to the rear undersurface of the single straddle tube 16.

A seat 70 is affixed to the top of a seat post 74 by means of a pivot bracket 72. It is important for the purposes of the treatment method of this invention that the seat 70 be of the common bicycle or straddle type, namely one which tapers from front to back, allowing the legs to be disposed comfortably on either side of the seat, in anatomically molded concavities designed therefor. An alternate type of straddle seat (not illustrated) is long and narrow, with little or no taper. It too is designed to dispose the user's legs on opposite sides thereof.

An adjustment collar 76 allows the effective height of the seat 70 to be controlled by the patient 2 or the attending physician. This is accomplished by releasing the set screw 78 and raising or lowering the seat post 74 in the direction of arrow B, which post is journaled within the seat column or tube 14. Other equivalent telescoping seat adjustment means could be substituted herein. Various forms of twist collars, removable pins, and the like are in use for this purpose.

The therapy or treatment method of this invention is practiced by a patient 2, utilizing the wheeled walker 1 hereof, as follows. First, the patient is provided with a wheeled walker constructed substantially according to the above description. Next, the seat 70 is adjusted so as to support a portion of the patient's weight, but not the entirety thereof, when the patient is standing in a normal upright posture with his or her buttocks 4 resting on the seat 70. The remainder of the patient's weight, preferably the major portion thereof, is supported by the legs 5, 6 and feet 7, 8. The patient stands with his or her right 5 and left 6 legs disposed on opposite sides of the straddle seat 70. The patient's right 7 and left 8 feet straddle the right and left sides, respectively, of the narrow straddle tube 16. The patient should then stand and walk the walker 1 with the torso 3 in a natural upright posture and the hands 9 on the handlebar 20. Ordinary footwear should be worn, i.e. shoes with soles capable of gripping the floor without sliding and supporting the feet in a normal manner (specifically, shoes not having wheels such as are used in the skating training method of U.S. Pat. No. 4,681,332); again in an effort to imitate the unimpaired ambulatory state. Some forward leaning of the torso 3 to facilitate steering is acceptable.

The shape of the seat 70 and the relatively narrow width of the straddle tube 16 allow the legs and feet to move forward and backward along a substantially normal stride pattern. When at rest, the patient 2 may lean the walker to one side or the other (due to the action of the elastic bushing means 38 described above) so as to comfortably shift weight from one leg to the other. When walking, some back and forth leaning of the walker 1 may also occur, depending on the natural stride of the patient 2.

This provides and promotes proper muscle exercise and joint alignment, thereby facilitating the patient's recovery. At the same time, stress is alleviated from damaged bones, joints, tendons, nerves, muscles and the like. As the patient 2 regains strength and health, the seat 70 should be adjusted downward to support successively smaller portions of his or her entire weight, until, at last, the patient is able freely to support his or her entire weight on his or her legs and feet while walking unassisted. However, even in the last stages of treatment (where the seat 70 may be lowered to the point where the patient 2 does not rest upon it at all when walking) continued use of the walker 1 will be helpful for restoring the patient's confidence in ambulation. It will also be available for occasional periods of rest.

The method of this invention may also be used to treat patients with permanently impaired ambulation, both to provide more comfort and mobility to the patient than, for example, a wheelchair, and to prevent further deterioration in the patient's muscles and joints. In this respect, it can be noted that the wheeled walker 1 of this invention is lighter than a wheelchair. It is also narrower than a wheelchair and many other types of existing walkers, so that it may be more freely maneuvered through narrow passageways and around obstructions. It may be stored and transported in a greater variety of vehicles.

While the above provides a full and complete disclosure of the preferred embodiments of this invention, various modifications, alternate constructions, and equivalents may be employed without departing from the true spirit and scope of the invention. Such changes might involve alternate steps, components, structural arrangements, sizes, operational features or the like. Therefore, the above description and illustrations should not be construed as limiting the scope of the invention which is defined by the appended claims.

What is claimed is:

1. A method of treating ambulatory disease in a human patient having a torso, buttocks, legs, feet and hands, which legs and feet execute a normal stride pattern, including the steps of:

providing a walker having a chassis which fits within the normal stride pattern without substantial obstruction thereof, straddle seat means affixed to the chassis which allows the patient's legs to be disposed moveably forward and backward on opposite sides thereof, and wheels on the underside of the chassis; and seating the patient on the walker so as to support a portion of the patient's weight, but not the entirety thereof, when the patient is standing in a normal upright posture with the buttocks resting on the seat means.

2. The method of claim 1 wherein:

the provided walker also has a rotatable handlebar which rotates at least one wheel of the walker.

3. The method of claim 2 wherein:

the provided walker also has means for telescopically raising or lowering the straddle seat means.

4. The method of claim 3 further including the step of:

having the patient walk in the normal stride pattern while steering the walker with the hands on the handlebar.

5. The method of claim 1 further including the step of:

providing the patient with footwear having wheelless soles capable of gripping the floor and supporting the feet.

6. The method of claim 5 wherein:

the provided walker also has a rotatable handlebar which rotates at least one wheel of the walker; and further including the step of having the patient walk in the normal stride pattern while steering the walker with the hands on the handlebar.

7. The method of claim 6 wherein:

the provided walker also has means for telescopically raising or lowering the straddle seat means.

8. The method of claim 7 wherein:

the provided walker has four wheels, two wheels on a front truck, the front truck operably connected to the handlebar so as to be rotatable therewith and two wheels on a rear truck, the rear truck affixed to the chassis so as to be stable with respect thereto.

9. The method of claim 8 wherein:

each truck includes elastic bushing means for allowing the walker to flexibly lean to one side or the other of the walker.

10. A method of treating ambulatory disease in a human patient having a torso, buttocks, legs, feet and hands, which legs and feet execute a normal stride pattern, including the steps of:

providing a walker having a chassis comprised of interconnected tubes all contained within a single plane, which chassis fits within the normal stride pattern without substantial obstruction thereof, telescopically adjustable straddle seat means affixed to the chassis which allows the patient's legs to be disposed moveably forward and backward on opposite sides thereof, a rotatable handlebar which rotates at least one wheel of the walker, and wheels on the underside of the chassis;

providing the patient with footwear having wheelless soles capable of gripping the floor and supporting the feet;

seating the patient on the walker so as to support a portion of the patient's weight, but not the entirety thereof, when the patient is standing in a normal upright posture with the buttocks resting on the seat means; and having the patient walk in the normal stride pattern while steering the walker with the hands on the handlebar.

11. The method of claim 10 wherein:

the provided walker has four wheels, two wheels on a front truck, the front truck operably connected to the handlebar so as to be rotatable therewith and two wheels on a a rear truck which is affixed to the chassis so as to be stable with respect thereto.

12. The method of claim 11 wherein:

each truck includes elastic bushing means for allowing the walker to flexibly lean to one side or the other of the walker.

* * * * *